United States Patent [19]

Sitz et al.

[11] Patent Number: 4,906,132

[45] Date of Patent: Mar. 6, 1990

[54] HIGH-LOAD UNDERGROUND DAM

[75] Inventors: Peter Sitz, Freiberg, German Democratic Rep.; Thomas Oellers, Dortmund, Fed. Rep. of Germany; Volker Köckritz; Frieder Hafner, both of Frieberg, German Democratic Rep.

[73] Assignees: Deilmann-Haniel GmbH, Dortmund, Fed. Rep. of Germany; Bergakademie Freiberg, Freiberg, German Democratic Rep.

[21] Appl. No.: 272,531

[22] Filed: Nov. 16, 1988

[30] Foreign Application Priority Data

Nov. 30, 1987 [DD] German Democratic Rep. ... 309645

[51] Int. Cl.[4] ..... E21D 9/00

[52] U.S. Cl. ..... 405/52; 405/53; 405/132; 405/150

[58] Field of Search ..... 405/53–59, 405/132, 150; 66/135, 118, 179

[56] References Cited

U.S. PATENT DOCUMENTS

| | | | |
|---|---|---|---|
| 2,459,227 | 1/1949 | Kerr | 405/53 X |
| 2,787,125 | 4/1957 | Benz | 405/53 |
| 2,855,757 | 10/1958 | Meade | 405/53 |
| 2,981,070 | 4/1961 | Seely | 405/53 |
| 3,184,922 | 5/1965 | Anton | 405/57 |
| 4,391,552 | 7/1983 | O'Hara | 405/53 X |
| 4,417,829 | 11/1983 | Berezoutzky | 405/59 X |
| 4,818,144 | 4/1989 | Mraz | 405/263 X |

FOREIGN PATENT DOCUMENTS

| | | | |
|---|---|---|---|
| 0941470 | 7/1982 | U.S.S.R. | 405/253 |

OTHER PUBLICATIONS

Shaft Sealing for Nuclear Waste Repositories by P. Sitz, Freiberg Mining Academy, Dept. of Mining Technology, German Democratic Republic, 1988.

*Primary Examiner*—Dennis L. Taylor

*Attorney, Agent, or Firm*—Herbert Dubno; Andrew M. Wilford

[57] ABSTRACT

A dam for sealing an underground passage extending along an axis is formed with a pair of end ridges themselves formed by—oppositely inclined inner and outer surfaces and at least one middle ridge also formed by a pair of oppositely inclined surfaces. The surface projected parallel to the axis of the outer end-ridge surfaces is larger than the surface projected parallel to the axis of the dam of the inner end-ridge surfaces and the middle ridge is offset outward, that is into the earth bounding the space, of the end ridges by a distance equal to at least the difference between the sizes of the projections.

4 Claims, 3 Drawing Sheets

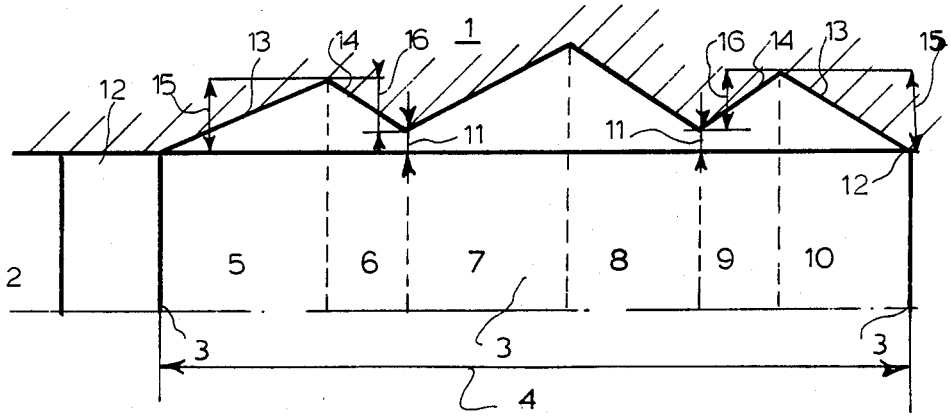
FIG.1
FIG.7
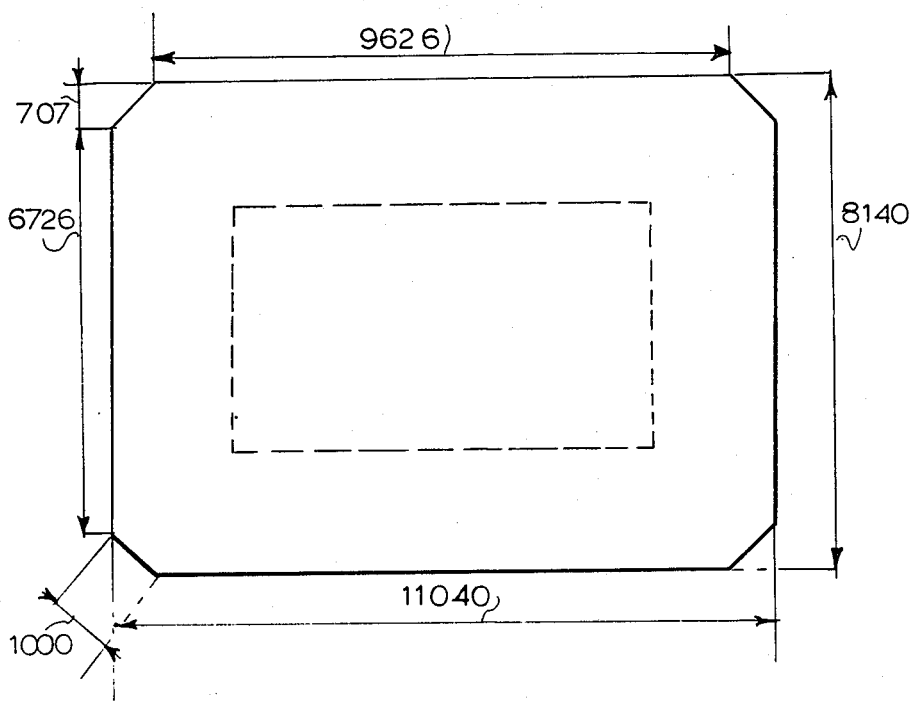

HIGH-LOAD UNDERGROUND DAM

FIELD OF THE INVENTION

The present invention relates to a dam for use in an underground passage or chamber. More particularly this invention concerns such a dam for sealing a passage in an inelastic, time-dependent earth or rock mass.

BACKGROUND OF THE INVENTION

Such dam structures are used to close off underground passages so that they can be used for storage. In particular these dams are used in order to prevent water from entering underground burial sites.

As a rule such dams are massive concrete structures which are provided with reinforcement and which are used along with seals to provide a durable and safe sealing of underground passages, acting in effect like a massive plug. The are described in *Querschnitsabdichtungen untertagiger Hohlraume durch Damme und Propfen* (P. Sitz, VEB Deutscher Verlag fur Grundstoffindustrie, Liepzig, 1982). Dams having a long life and providing a good cross-section seal are constituted as cup-shaped multiply ridged, that is multiply frustoconical, dams. Such a multiply ridged dam is for example formed with a three-part corrugation or ridge system. The three ridges have flank angles which decrease from the pressure side so that the main tension (pressure) vector is perpendicular to the fracture surfaces. The impinging tensions are taken up by an additional transverse reinforcement of the air-side or inside of the ridges.

Normally the height of the ridges is between 0.8r and 1.0r (r being the passage radius). The main disadvantage of such dams is that as a result of the liquid pressure in a large dam area there are tensions which increase with the modulus of elasticity of th surrounding rock or earth. As the dams get bigger these tensions decrease and asymptotically approach a final level. It is possible to form the multiply ridged or prismatoid dam out of four frustoconical parts. As a result of the liquid pressure there are tensions parallel to the dam which once again are present in locations of low modulus of elasticity and which must be taken up by a reinforcement which is normally constituted of steel reinforcing rings and yokes. Although with such a dam structure the maximum tensions and the passage subjected to tension are smaller than with the multiply ridged dams, it is still necessary to provide some means to maintain the dam capacity and the seal in every case.

Calculating the size of the dams relative to the earth load has hitherto been a fairly haphazard process mainly involving guesswork that only poorly emulated real conditions. New detailed research regarding underground dams of standard geometry multiply ridged, multiply frustoconical, or prismatoidal—is described in *Gebirgsmechanische Untersuchungen zur Standischerheit eines Dammbauwerkes* (BGR, Hannover, May 1985). This research has shown that as a result of the earth load there are also axial tensions in the dam structure which primarily are manifested as bending in the regions of smallest diameter. In addition tensions can result from nonuniform earth loads between the ends and the middle of the support.

The problem of reducing the axial tensions created by the earth pressure is particularly important in cases where the dams are used in regions where the earth is very rheologically inelastic in dependance on time, as for example in stone salt domes where there are relatively minor end loads. These disadvantageous tensions are taken up within certain limits by reinforcement of the dam structure. This necessitates a substantial extra expense for material and time. Hitherto the problem of axial tensions as a result of earth load is not fully accounted for because it was only possible to guess at the actual effects of the earth load or these loads were calculated under ideeal circumstances not strictly corresponding to actual circumstances.

OBJECTS OF THE INVENTION

It is therefore an object of the present invention to provide an improved high-load underground support.

Another object is the provision of such an improved a high-load underground dam whch overcomes the above-given disadvantages, that is which avoids axial tensions so that no axial reinforcement is needed and which as a result can be made with lower-quality materials.

SUMMARY OF THE INVENTION

A dam for sealing an underground passage extending along an axis according to the invention is formed with a pair of end ridges themselves formed by oppositely inclined inner and outer surfaces and at least one middle ridge also formed by a pair of oppositely inclined surfaces. The surface projected parallel to the axis of the outer end-ridge surfaces is larger than the surface projected parallel to the axis of the dam of the inner end-ridge surfaces and the middle ridge is offset outward, that is into the earth bounding the space, of the end ridges by a distance equal to at least the difference between the sizes of the projections.

As a result the inner outer-ridge surfaces terminate at their inner edges outward of the outer-ridge surfaces. The size of the offset depends on the pressure being exerted that is in turn determined rheologically based on the type of rock or earth the dam is in. This can be calculated numerically by use of inelastic finite-element-programs Factors for the calculation are the rock or earth parameters, the dam geometry, the material of the support, and special edge requirements which are determined by modification of the dam for specific circumstances. If the tensions are known, the structure according to this invention is made long enough to compensate for the axial tensions or to produce the desired axial compression. As a result the dam has great load-bearing capacity and imperviousness to water, and can be made relatively cheaply The offset geometry of the ridges of the underground dam ensures that the axial pressure is distributed along the full length of the support.

The effect of the offset ridges is increased according to the invention when brace structures are provided at the opposite ends of the support. As a result there is no static loading of these brace structures. They ensure on the other hand a largely constant loading of the support. The bracing structures are according to another feature of this invention fitted complementary to the space. Thus the offset can be minimized.

If the geometric ratings of the dam are exceeded there can be disadvantages axial tensions. In order to avoid this with some surety, according to this invention the middle ridge is offset outward by a distance greater than the difference. This increases the safety factor.

The invention is particularly novel in that it makes possible for the first time to compensate for axial tensions in inelastic/time-dependent (rheological) material characteristics. The compression achieved according to this invention eliminates the negative influences on the permeability of the cross-section seal. In fact an axial reinforcement of the dam can be eliminated.

DESCRIPTION OF THE DRAWING

The above and other objects, features, and advantages will become more readily apparent from the following, reference being made to the accompanying drawing in which:

FIG. 1 is a diagram illustrating the instant invention;

FIG. 4, 5, 6, and 7 are outlines of the sections taken along respective lines IV—IV, V—V, VI—VI, and VII—VII of FIG. 3.

SPECIFIC DESCRIPTION

Figure 2:
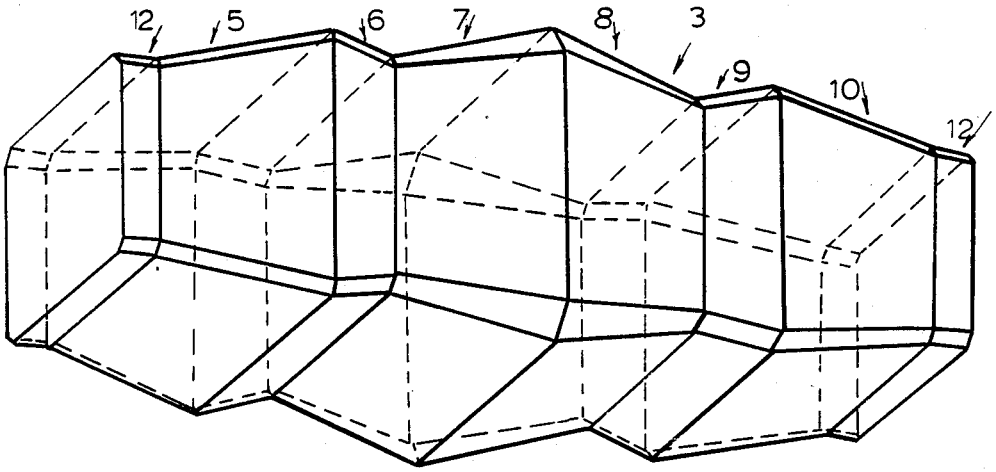
FIG. 2 is a perspective/isometric view of the dam in accordance with this invention.
Figure 3:
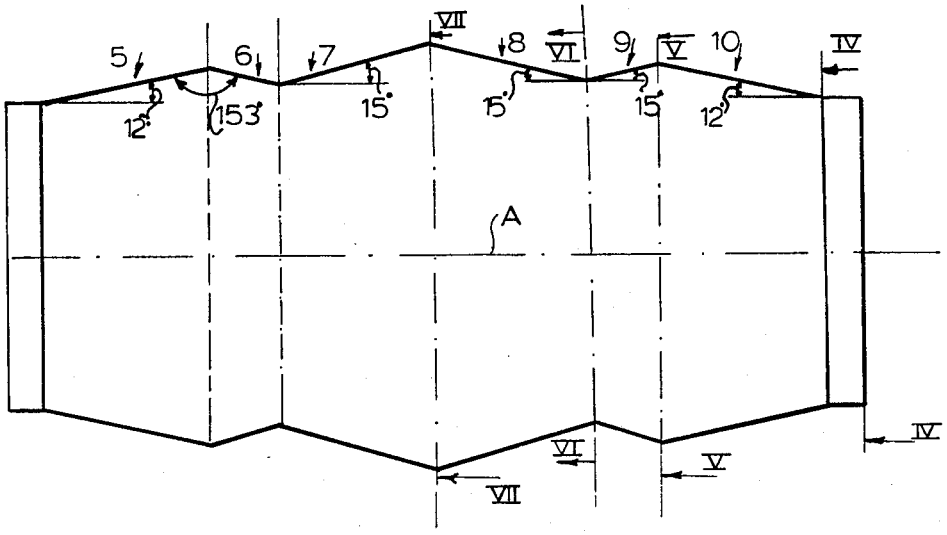
FIG. 3 is a top-view outline illustrating the dimensions of the dam.
Figure 4:
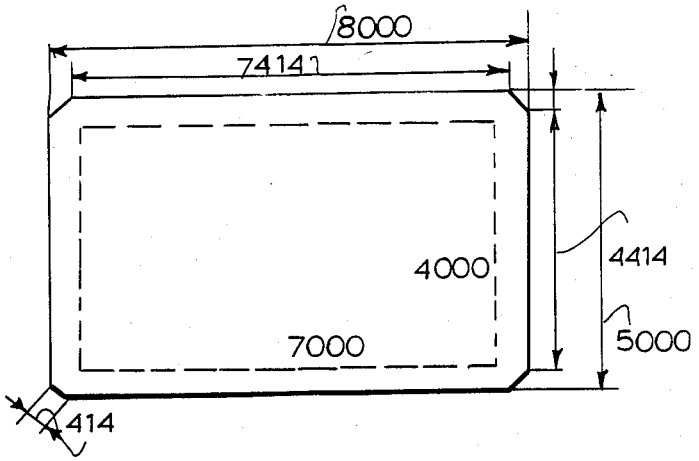
Figure 5:
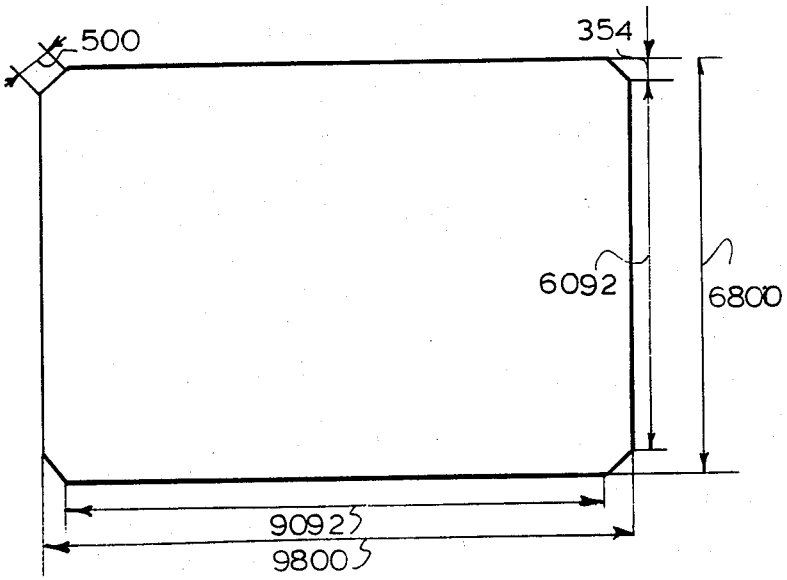
Figure 6:
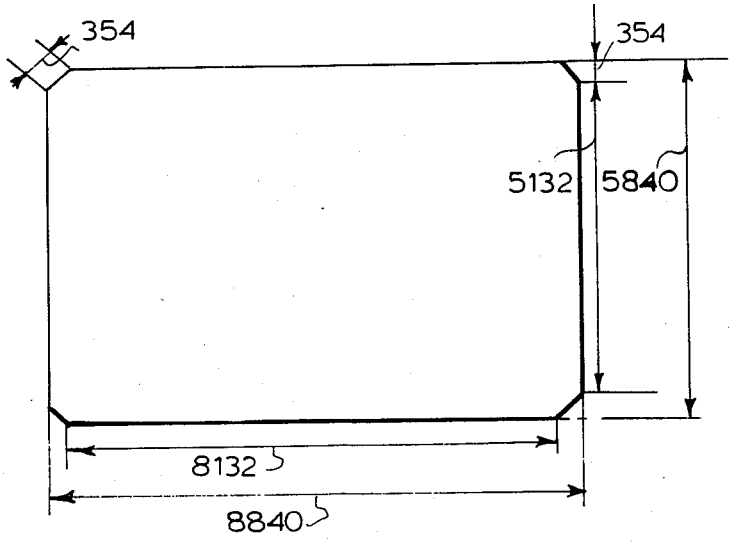

As seen in the drawing a mountain or earthen mass 1 of inelastic time-dependent deformation characteristics, for instance a salt dome, is formed with a tunnel or passage 2 generally centered on an axis A and sealed by a dam 3 designed to accept the weight of the surrounding earth 1.

The overall length 4 of the dam 3 is determined largely by the size of the load at the ends, as described in the above-cited reference of P. Sitz. In order to compensate for axial tensions in the dam 3 caused by the weight of the earth in the contact regions between the earth and the dam 3 at the end regions 5 and 10 of the dam 3 and to overcome axial pressures in the entire structure 3 the following features are important:

The transverse dimension is increased in the intermediate regions 6, 7, 8, and 9 by an amount that corresponds to the offset 11. In this manner the height 15 of the projection perpendicular to the centerline or axis of the dam 3 of the surface 13 is bigger than the similar dimension 16 of the projection of the surface 14 immediately inward therefrom so that the inner edge of the surface 14 is spaced outward by the offset distance 11 from the outer edge of the surface 13.

In one embodiment of the dam of this invention the length of the tapered regions is between 2 m and 4 m. According to cross-sectional size of the passage 2 at 600 m to 1000 m depths dimensions 15 and 16 of between 0.3 m and 0.8 m are used.

The different shapes of the ridges and their surfaces 13 and 14 has the effect in combination with the difference 11 of creating a axial compression of the entire structure so as to compensate for the axial tension.

In order to minimize the offsets and also the difference 11 it is advantageous to provide extensions or bracing structures 12 at the ends of the dam 3. This resists static loading and ensures a largely constant earth loading of the structure 3.

Below is a table illustrating the dimensions (in mm) of a typical dam of rectangular section with chamfered corners according to this invention:

TABLE

| | |
|---|---|
| Hor. dim. of section 5 or 12 at inner edge | 8000 |
| Hor. dim. of section 5 or 12 at outer edge | 9800 |
| Hor. dim. of section 6 or 9 at inner edge | 8840 |
| Hor. dim. of section 7 or 8 at outer edge | 11040 |
| Ver. dim. of section 5 or 12 at inner edge | 5000 |
| Ver. dim. of section 5 or 12 at outer edge | 6800 |
| Ver. dim. of section 6 or 9 at inner edge | 5840 |
| Ver. dim. of section 7 or 8 at outer edge | 8140 |
| Length of section 12 | 1000 |
| Length of section 5 or 10 | 4200 |
| Length of section 6 or 9 | 1800 |
| Length of section 7 or 8 | 4000 |
| Angle between sections 5 and 6 or 9 and 10 | 153° |
| Angle between section 5 or 10 and axis A | 12° |
| Angle between section 6 or 9 and axis A | 15° |
| Angle between section 7 or 8 and axis A | 15° |

The chamfered corners have a dimension measured on the flat equal to substantially less than 10% of the dimension of either of the adjoining sides.

In another system of this design all of the above linear dimensions are used, minus 3000 mm.

We claim:

1. A dam for sealing an underground passage extending along an axis, the dam being formed with a pair of end ridges formed by oppositely inclined inner and outer surfaces and at least one middle ridge also formed by a pair of oppositely inclined surfaces, the surface projected parallel to the axis of each of the outer end-ridge surfaces being greater than the surface projected parallel to the axis of the dam of the respective inner end-ridge surfaces and the middle ridge being offset from the axis outward of the end ridges by a distance equal to at least the difference between the sizes of the projections.

2. The dam defined in claim 1, further comprising brace structures at the opposite ends of the support.

3. The dam defined in claim 2 wherein the brace structures fit complementary to the space.

4. The dam defined in claim 1 wherein the middle ridge is offset outward by a distance greater than the difference.

* * * * *